US006325221B2

(12) United States Patent
Parham

(10) Patent No.: US 6,325,221 B2
(45) Date of Patent: Dec. 4, 2001

(54) MERCHANDISING DISPLAY TRACK DEVICE OF MULTIPLE-PIECE CONSTRUCTION

(75) Inventor: Dennis E. Parham, Kennesaw, GA (US)

(73) Assignee: Display Industries, LLC, Smyrna, GA (US)

( * ) Notice: Subject to any disclaimer, the term of this patent is extended or adjusted under 35 U.S.C. 154(b) by 0 days.

(21) Appl. No.: 08/967,381

(22) Filed: Nov. 8, 1997

(51) Int. Cl.[7] ..... A47F 7/00

(52) U.S. Cl. ..... 211/59.2; 211/74; 211/183; 312/72

(58) Field of Search ..... 211/59.2, 59.3, 211/74, 175, 183, 189; 312/45, 72

(56) References Cited

U.S. PATENT DOCUMENTS

| | | | | |
|---|---|---|---|---|
| 4,478,337 | | 10/1984 | Flum | 211/49 D |
| 4,630,739 | * | 12/1986 | Levenberg | 211/189 |
| 4,685,574 | * | 8/1987 | Young et al. | 211/59.2 |
| 4,724,968 | | 2/1988 | Wombacher | 211/59.3 |
| 4,730,741 | * | 3/1988 | Jackle, III et al. | 211/59.3 |
| 4,762,236 | * | 8/1988 | Jackle, III et al. | 211/59.3 |
| 4,785,945 | * | 11/1988 | Rowse et al. | 211/59.2 |
| 4,836,390 | * | 6/1989 | Polvere | 211/59.3 |
| 4,958,739 | * | 9/1990 | Spamer | 211/59.2 X |
| 4,997,094 | | 3/1991 | Spamer et al. | 211/153 |
| 5,024,336 | | 6/1991 | Spamer | 211/59.2 |
| 5,050,748 | | 9/1991 | Taub | 211/59.2 |
| 5,160,051 | * | 11/1992 | Bustos | 211/59.2 |
| 5,203,463 | * | 4/1993 | Gold | 211/59.3 |
| 5,240,126 | | 8/1993 | Foster et al. | 211/59.3 |
| 5,314,081 | * | 5/1994 | Carroll | 211/184 |
| 5,351,838 | | 10/1994 | Flum | 211/59.2 |
| 5,458,248 | | 10/1995 | Alain | 211/175 |
| 5,531,336 | | 7/1996 | Parham et al. | 211/183 |
| 5,542,552 | * | 8/1996 | Yablans et al. | 211/59.3 |
| 5,562,217 | * | 10/1996 | Salveson et al. | 211/51 X |
| 5,595,310 | * | 1/1997 | Spamer et al. | 211/74 X |
| 5,634,564 | * | 6/1997 | Spamer et al. | 211/175 X |

(List continued on next page.)

FOREIGN PATENT DOCUMENTS

| | | | |
|---|---|---|---|
| UM 2522416 | 11/1994 | (JP) | 211/153 |

OTHER PUBLICATIONS

Advertisement brochure for the Mead product designated as "Ultra–Tracker tray".

*Primary Examiner*—Daniel P. Stodola
*Assistant Examiner*—Khoa Tran
(74) *Attorney, Agent, or Firm*—John L. James

(57) ABSTRACT

A merchandising track device for displaying articles is disclosed. The device comprises first and second elongate track members formed separately as two discrete structures. The first and second members are connected together in an end-to-end, longitudinally adjacent relationship. Each member comprises a track base for carrying articles for sliding movement along the respective member, and at least one article-guiding side wall upstanding from the track base of the respective member and extending along the respective member. The one side wall of the first member is disposed in general longitudinal alignment with the one side wall of the second member. The track device further comprises a locking mechanism for interconnecting the one side wall of the first member and the one side wall of the second member to lock the first and second members in position relative to each other. The locking mechanism comprises a part of the first member for preventing longitudinal displacement of the one side wall of the first member relative to the one side wall of the second member. In a track device in another form, the second member comprises a tongue extending longitudinally from its track base which tongue defines an end of the second member. The first member has an end-opening socket for receiving the tongue so that the track bases of the first and second members are interconnected to form a continuous floor for slidably supporting the articles.

17 Claims, 9 Drawing Sheets

U.S. PATENT DOCUMENTS 5,645,176 * 7/1997 Jay ..... 211/59.2
5,665,304 * 9/1997 Heinen et al. ..... 211/59.3 X
5,685,664 * 11/1997 Parham et al. ..... 211/59.3 X
5,695,074 * 12/1997 Wiese ..... 211/59.2
5,788,090 * 8/1998 Kajiwara ..... 211/59.2
6,068,139 * 5/2000 Brozak, Jr. ..... 211/59.2
6,068,142 * 5/2000 Primiano ..... 211/183
6,082,556 * 7/2000 Primiano et al. ..... 211/59.2
6,142,316 * 11/2000 Harbour et al. ..... 211/59.2
6,189,734 * 2/2000 Apps et al. ..... 221/193

* cited by examiner

MERCHANDISING DISPLAY TRACK DEVICE OF MULTIPLE-PIECE CONSTRUCTION

BACKGROUND OF THE INVENTION

This invention relates to a display track device for merchandising articles, and more particularly to a channel-shaped track device of a multiple-piece construction which enables low-cost molding of such devices.

Channel-shaped track devices have been used in the merchandising of a variety of products. The track devices, typically, are supported on a support surface such as a shelf in a tilted condition. Each device receives articles in a row so that the received articles slide or gravity feed one after another to the front of the respective track as the leading articles in the row are removed from the track. Among these known track devices, two-piece construction devices are disclosed, for example, in U.S. Pat. No. 4,478,337 (Flum); U.S. Pat. No. 4,724,968 (Wombacher); and U.S. Pat. No. 5,240,126 (Foster et al). Wombacher and Foster et al each disclose a track device having a separate front stopper attached to the track base. Because these patents require a transversely extending front wall to assure the structural strength of the device, the front stoppers taught by these patents cannot be used to construct some type of tracker devices wherein such front walls are not desired. Front walls would conflict with the arrangement shown, for example, in U.S. Pat. No. 5,645,176 to Jay where increased visibility of leading articles is intended.

Flum's device includes front and rear separate members arranged in telescoping relationship which may be employed in Jay's track device. However, the Flum patent requires side walls of a hollow, double-wall structure which is not only expensive but also bulky such that it requires substantial dead space between two adjacent tracks.

What is needed, therefore, is an improved multiple-piece construction track device which allows economical application of a variety of designs to different portions of the track.

SUMMARY OF THE INVENTION

The track device of the invention has a special joint for firmly connecting two or more separate lengths of the track device together to create a one continuous track.

The present invention in one aspect provides a merchandising track device comprising first and second elongate track members formed separately as two discrete structures. The first and second members are connected together in an end-to-end, longitudinally adjacent relationship. Each member comprises a track base for carrying articles for sliding movement along the respective member, and at least one article-guiding side wall upstanding from the track base of the respective member and extending along the respective member. The one side wall of the first member is disposed in general longitudinal alignment with the one side wall of the second member. The track device further comprises locking means for interconnecting the one side wall of the first member and the one side wall of the second member to lock the first and second members in position relative to each other. The locking means comprises longitudinal retention means for preventing longitudinal displacement of the one side wall of the first member relative to the one side wall of the second member.

This arrangement allows low-cost application of a variety of designs as well as materials to different parts of the track device. For example, an expensive mold of a complicated structure can be replaced by two or more less expensive, less complicated molds to form the device of the invention. Further, expensive material can be used only for a particular portion of the device where the use of such material is essential.

In a preferred embodiment, the longitudinal retention means comprises an overhang extending rearward from the one side wall of the first member along the upper edge of the one side wall of the second member, and a lug depending from the overhang and received in a cutout formed along the upper edge of the one side wall of the second member. In addition to the longitudinal retention means, the locking means may also include lateral retention means for preventing lateral displacement of the one side wall of the first member relative to the one side wall of the second member. The lateral retention means comprises a pair of engaging tabs provided for the first member. The engaging tabs are disposed respectively alongside the opposite side surfaces of the one side wall of the second member, and at least one of the engaging tabs is formed on the lug.

The present invention in another aspect provides a merchandising track device comprising first and second separately formed, elongate track members. The first and second members are connected together in an end-to-end, longitudinally adjacent relationship. Each member comprises an article-carrying track base. The second member comprises a tongue extending longitudinally from the track base of the second member which tongue defines an end of the second member. The first member has an end-opening socket for receiving the tongue so that the track bases of the first and second members are interconnected to form a continuous floor for slidably supporting articles. This arrangement also allows economical application of a variety of designs and materials to different parts of the track device.

In a preferred embodiment, the track base of the first member comprises upper and lower opposed walls, and the socket is defined between the upper and lower walls.

In another preferred embodiment, the upper surface of the tongue is disposed below the continuous floor of the device so that the upper surfaces of the track bases may lie in a common plain. The tongue may be provided with a downwardly projecting hooking element, and the track base of the first member may have a transversely extending edge for engaging the hooking element to prevent longitudinal displacement of the first member with respect to the second member.

The present invention in a still another aspect provides a merchandising track device comprising an elongate body, and a front piece formed as a discrete structure and attached to the front end of the body. The body comprises a track base for carrying a row of articles for sliding movement along the body, and at least one article-guiding side wall upstanding from the track base and extending along the body. The front piece provides a stopper for preventing the leading article in the row from exiting the track device. The front piece comprises a deck for supporting the leading article, at least one longitudinally extending upright wall upstanding from the deck and disposed in general longitudinal alignment with the one side wall, and locking means for interconnecting the one upright wall and the one side wall to lock the front piece in position relative to the body.

The elongate body and the front piece may be molded from either plastic or metal (e.g., aluminum, aluminum compound or the like). The body and the front piece may be formed from different material. Although any plastic or metal may be used to construct the device of the invention, the most preferred material for the body is polystyrene whereas the most preferred material for the front piece is polycarbonate.

A preferred embodiment of the locking means comprises lateral retention means for preventing lateral displacement of the one upright wall relative to the one side wall. Such lateral retention means may be a pair of engaging tabs provided for the one upright wall which engaging tabs are disposed alongside the opposite side surfaces of the one side wall, respectively. These engaging tabs are disposed with a lateral gap therebetween to receive in the gap an edge of the one side wall. The engaging tabs may be opposed to each other across the thickness of the one side wall. Alternatively, the engaging tabs may be disposed at positions offset from each other along the length of the one side wall.

Another preferred embodiment of the locking means comprises longitudinal retention means for preventing longitudinal displacement of the one upright wall relative to the one side wall. The longitudinal retention means may comprise an overhang extending rearward from the one upright wall along the upper edge of the one side wall, and a lug depending from the overhang. Such a longitudinal retention means cooperates with a cutout formed along the upper edge of the one side wall to receive the lug.

The aforementioned lateral retention means may also be incorporated into the arrangement with the longitudinal retention means which lateral retention means comprises a pair of engaging tabs provided for the one upright wall. In such an arrangement, at least one of the engaging tabs is formed on the lug. In the arrangement where both the engaging tabs are formed on the lug, the lug may have a thickness greater than the thickness of the one side wall. Alternatively, in the arrangement wherein only one of the engaging tabs is formed on the lug, the other tab may be formed on the one upright wall or on the overhang.

The present invention in a further aspect provides a merchandising track device comprising an elongate body and an attached front piece. The body comprises a track base for supporting a row of articles for sliding movement along the body, and a tongue extending forwardly from the track base and defining the forward end of the body. The front piece provide a stopper for the leading article in the row. The front piece comprises a deck for supporting the leading article which deck has a socket for receiving the tongue so that the deck and the track base are interconnected to form a continuous floor for slidably supporting the articles.

In a preferred embodiment, the deck comprises upper and lower opposed walls, and the socket is defined between the upper and lower walls.

In another preferred embodiment, the upper surface of the tongue is disposed below the continuous floor so that the upper surface of the deck and the upper surface of the track base may lie in a common plain. The tongue may be provided with a downwardly projecting hooking element, and the deck may have a transversely extending edge for engaging the hooking element to prevent forward displacement of the front piece.

The objects and advantages of the present invention will be apparent from the following description, the accompanying drawings and the appended claims.

DETAILED DESCRIPTION OF THE PREFERRED EMBODIMENTS

Figure 1:
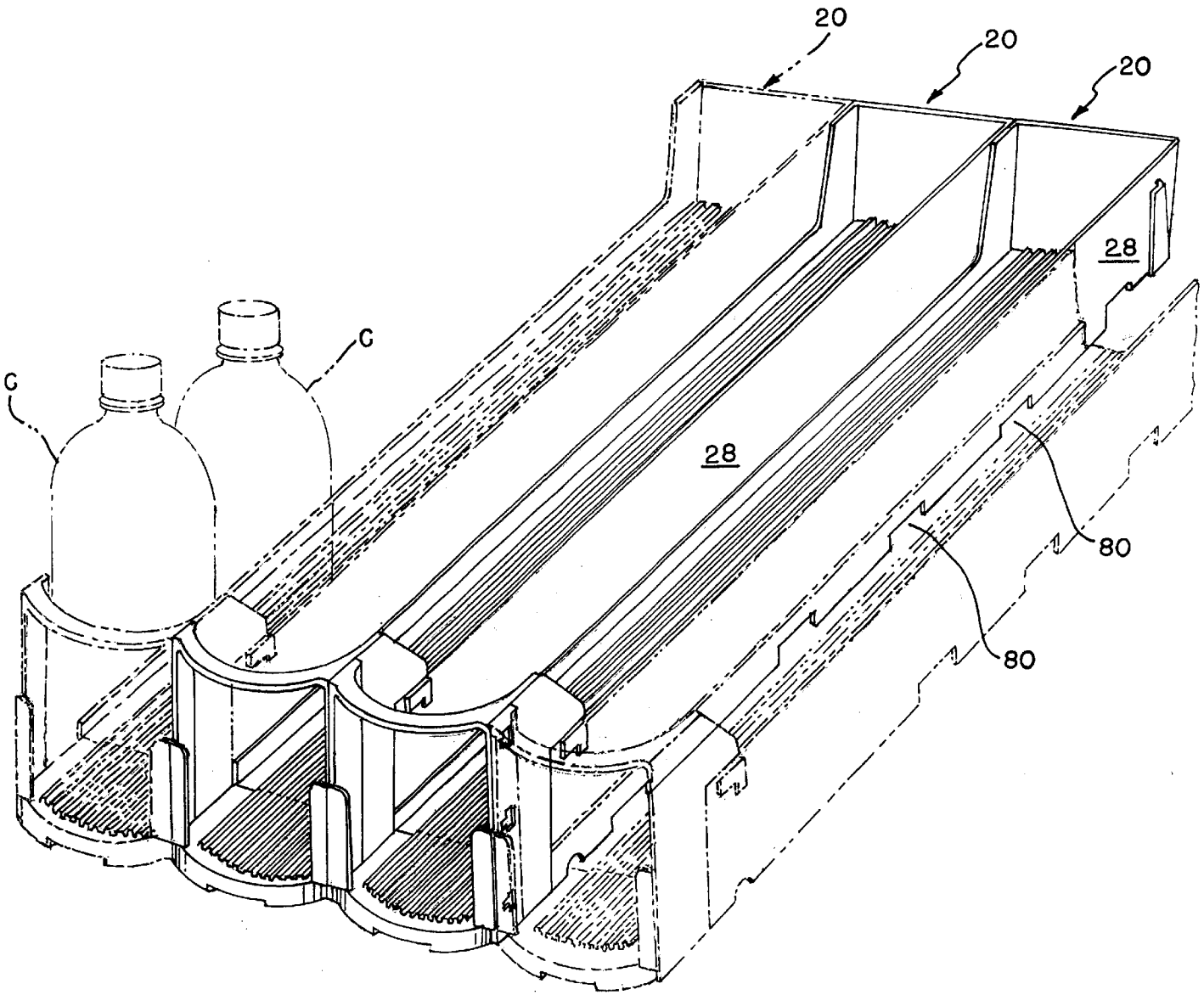
FIG. 1 is a perspective view of a shelf unit assembled from a plurality of track devices according to the present invention.

FIG. 1 illustrates a display shelf unit assembled from multiple track devices according to the present invention. This shelf unit is designed to merchandise articles C such as bottled or canned drink products. The shelf unit includes a plurality of elongate track devices 20 detachably interconnected in a side-by-side, transversely adjacent relationship. The number of the track device 20 used to assemble the shelf unit is determined such that the size of the shelf unit is suitable for placement onto an existing display shelf in a retail store in which the unit is desired to be installed. The interconnection of two adjacent track devices is achieved by connecting means such as connector slots 80 (shown in FIG. 1) cooperating with L-shaped horizontal connector elements 82 (only one shown in FIG. 2). Details of the slots 80 and the elements 82 are described in U.S. Pat. No. 5,634,564 which is hereby incorporated by reference. Additional connecting means are provided at the front portion of each device which additional means will be described later.

The shelf unit may be supported on a horizontal surface and may preferably be incorporated with a spring-loaded pusher for moving the loaded articles forwardly of the unit. An example of conventional pushers is shown in U.S. Pat. No. 5,634,564. However, the shelf unit may also be supported on a forwardly and downwardly tilted surface. In a tilted condition, each track device 20 operates as a so called "gravity feed" dispensing device which does not require any mechanical pushers. On a gravity feed device, the loaded articles have a natural tendency to automatically slide downwardly and forwardly to the front end of the track. The angle of tilt from the horizontal may vary somewhat but such an angle may be about 1 to 20 degrees and preferably about 3.5 to 8 degrees. The angle of tilt in most applications of the invention may be approximately 6 degrees from horizontal.

Figure 2:
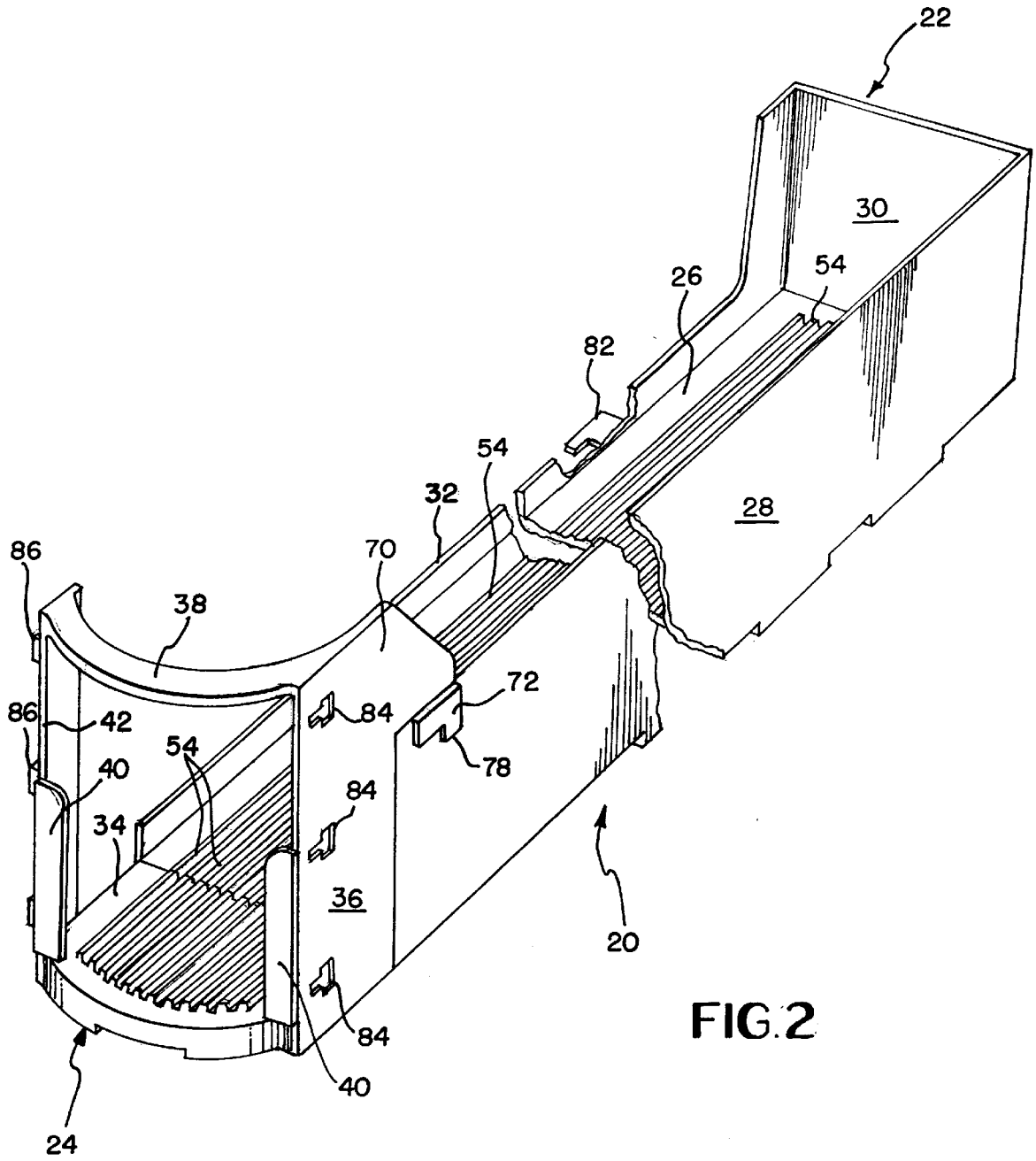
FIG. 2 is a fragmentary perspective view of one of the track devices in FIG. 1.
Figure 3:
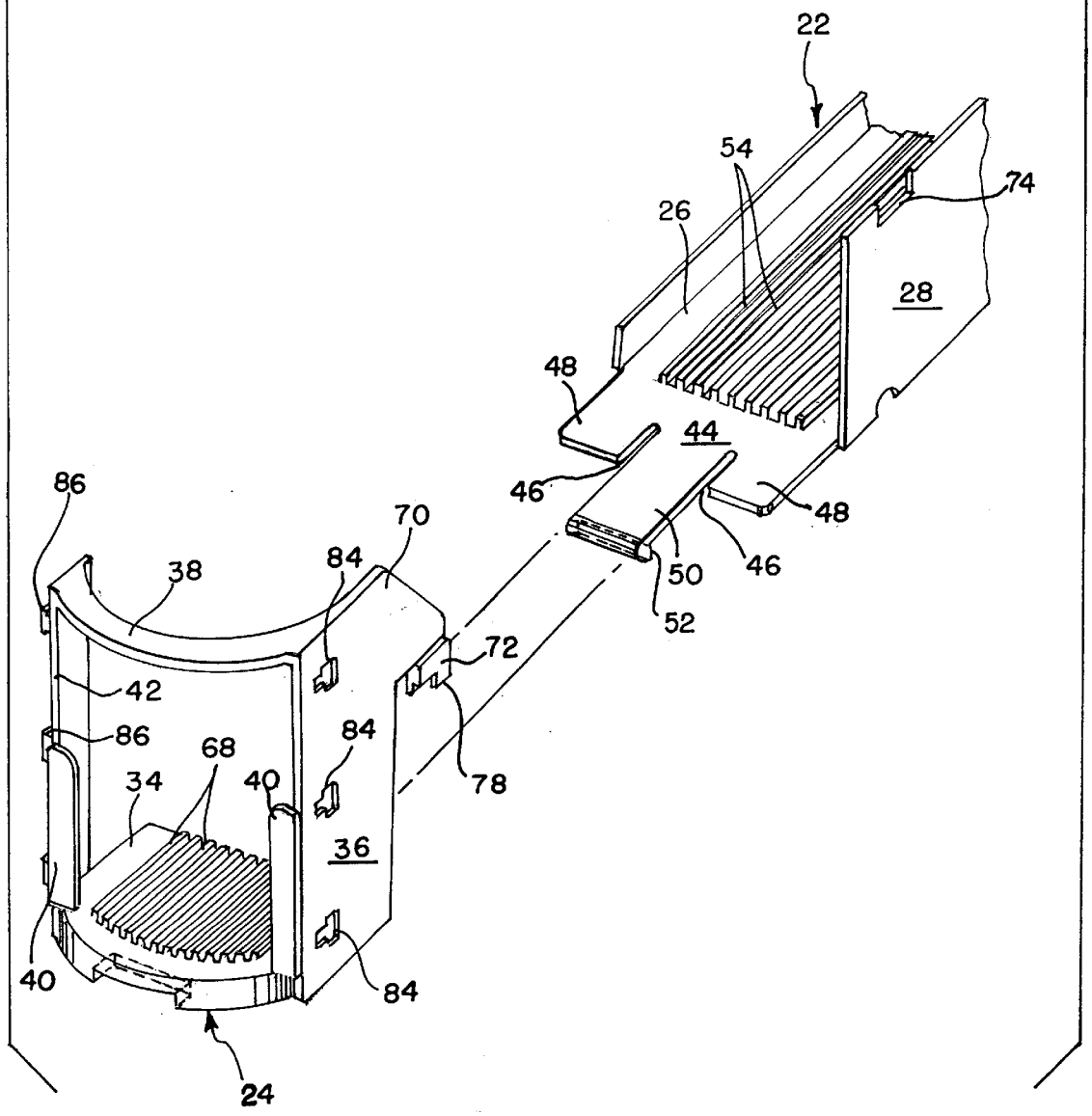
FIG. 3 is an exploded perspective view of the track device in FIG. 2.

FIGS. 2 and 3 illustrate one of the track devices 20 in the form separated from the shelf unit. As all the devices 20 are virtually the same in size and structure, only one device is described hereinafter. As illustrated, the track device 20 has a two-piece construction formed of molded plastic material and includes a first member or front piece 24 and a second member or elongate track body 22. The body 22 includes an article-supporting track base 26, an article-guiding side wall 28, a rear wall 30, and a side lip 32. The side wall 28 is upstanding from one of the side edges of the track base 26. The rear wall 30 is upstanding from the rear end of the track base 26. The side lip 32 is formed along the other side edge of the track base 26. The track base 26, the side wall 28 and the side wall of the adjacent track body 22 (shown in FIG. 1), in cooperation, define a channel for receiving a row of articles C.

Figure 4:
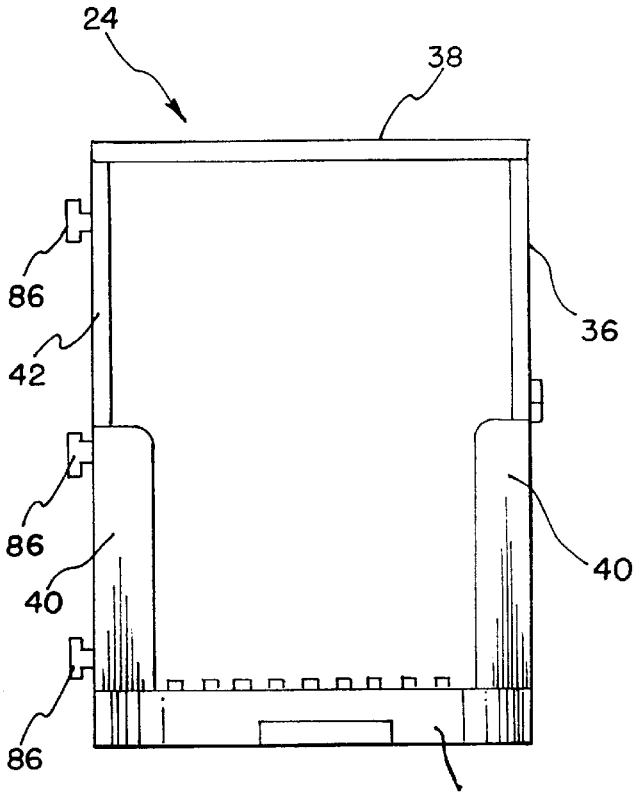
FIG. 4 is a front elevation of the front piece in FIG. 3.

The front piece 24 is molded separately from the body 22 to provide a front stopper for preventing the leading article in the row from exiting the track device. As illustrated in FIGS. 2, 3 and 4, the front piece 24 includes a track base or deck 34, a longitudinally extending side wall or upright wall 36, an upper stopper element 38, and a pair of lower stopper elements 40. The upright wall 36 is upstanding from one of the opposite side edges of the deck 34 to be disposed in general longitudinal alignment with the side wall 28. The upper stopper element 38 extends transversely of the device 20 to bridge between the respective upper ends of the upright wall 36 and a post 42 which is upstanding from the other side edge of the deck 34. The upper stopper element 38 is the portion against which the leading article on the respective device 20 rests when it is arrested by the front piece 24. Details of the upper stopper element are described in U.S. Pat. No. 5,645,176 which is hereby incorporated by reference. The lower stopper elements 40 extend upwardly from the deck 36 along the respective front edges of the upright wall 36 and the post 42. These lower stopper elements 40 cooperate with the upper stopper element 38 to arrest the leading article.

To interconnect the front piece 24 with the body 22, a tongue 44 is formed integrally with the body 22 as shown in FIG. 3. The tongue 44 extends forwardly from the track base 26 and defines the forward end of the body 22. A pair of notches 46 are formed in the tongue 44 to divide the tongue 44 into three portions, i.e., a pair of side portions 48 and a medial portion 50. Due to the notches 46, the medial portion 50 exhibits substantial flexibility. The medial portion 50 is provided along its transversely extending free end edge with a downwardly projecting hooking rib 52.

The upper surface of the tongue 44 is disposed below a common plane in which the tops or peaks of upwardly projecting parallel ribs 54 lie. The ribs 54 are formed integrally with the track base 26 along the length of the track device 20 to minimize friction between the track base 26 and the articles to be carried thereon. In other words, the ribs 54 provide a part of the "continuous floor" for slidably supporting articles, which continuous floor lies in the aforesaid common plane. Because the upper surface of the tongue 44 is below the common plane, the deck 34 is allowed to cooperate with the ribs 54 to form the continuous floor when the front piece 24 is attached to the body 22. This will be described later more specifically. The ribs 54, preferably, are arranged at equal spacings and are of a generally trapezoidal cross section.

Figure 5:
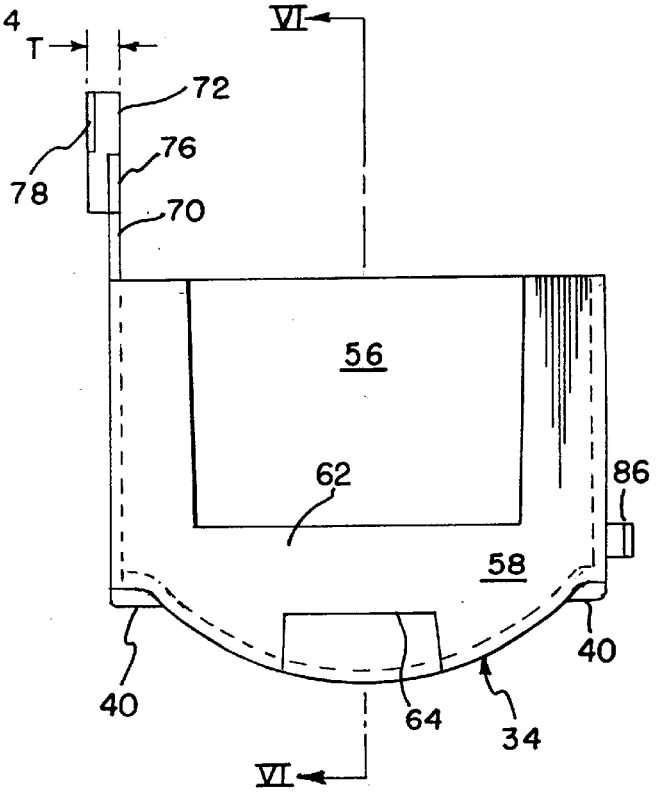
FIG. 5 is a bottom plan view of the front piece in FIG. 3.
Figure 6:
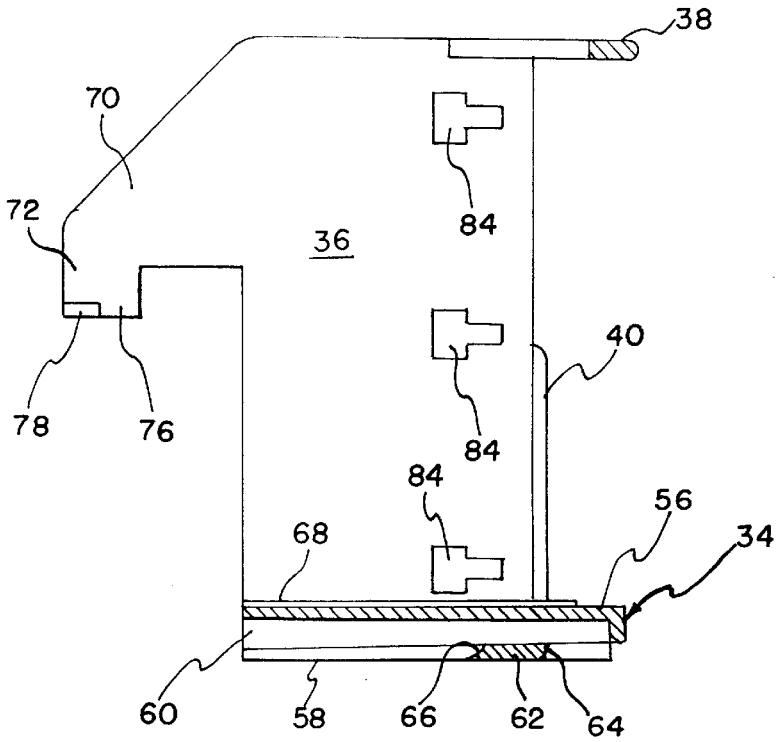
FIG. 6 is a view taken along the line VI—VI in FIG. 5.

The means for cooperating or mating with the tongue 44 is provided for the front piece 24 in the form of a socket 60 that is defined between the upper and lower opposed walls 56 and 58 of the deck 34 (see FIGS. 5 and 6). The lower wall 58 includes a strip portion 62 extending transversely of the deck 34. This strip portion 62 has a front face which provides a transversely extending engaging edge 64 for engagement with the hooking rib 52 of the tongue 44. The rear face 66 of the strip portion 62 slopes downwardly and rearwardly to facilitate insertion of the tongue 44 into the socket 60.

Figure 7:
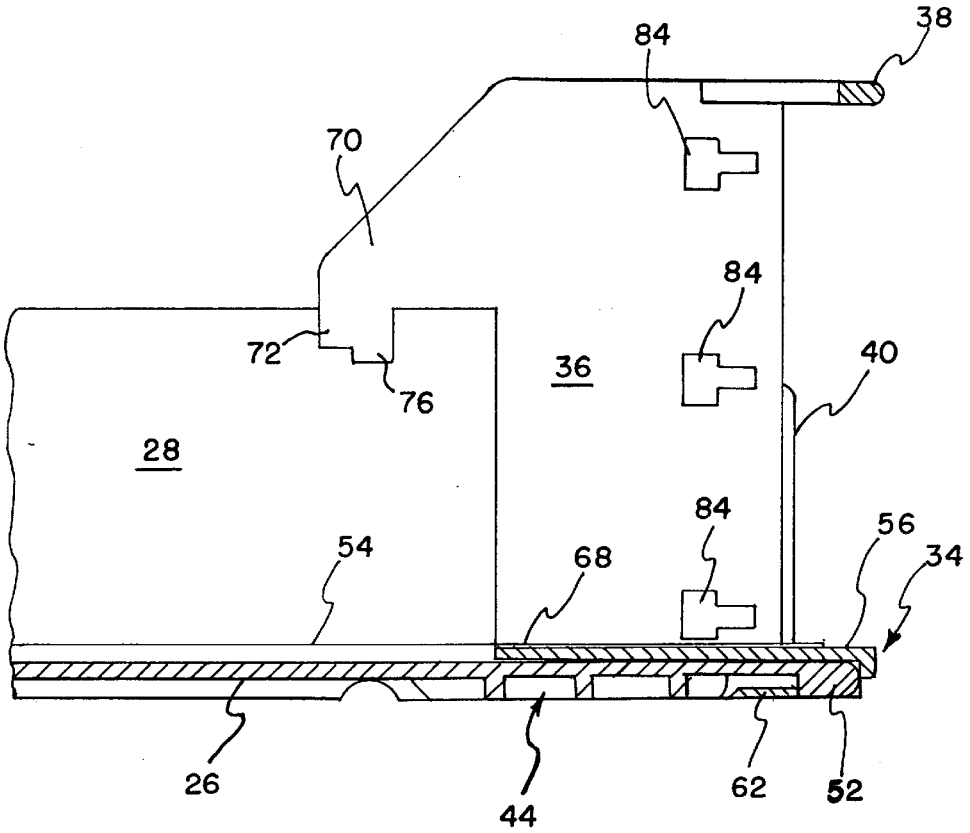
FIG. 7 is a view similar to FIG. 6 except that the body is connected to the front piece by the insertion of the tongue into the socket.

Further, the upper wall 56 of the deck 34 is formed integrally with a plurality of upwardly projecting parallel ribs 68. These ribs 68 are arranged such that they are brought into longitudinal alignment with the ribs 54 of the track base 26 when the front piece 24 is attached to the track body 22. However, the vertical size of the ribs 68 is substantially less than that of the ribs 54 so that when the body 22 and front piece 24 are interconnected, the tops or peaks of the ribs 68 and those of the ribs 54 can lie in the aforesaid common plane to provide the "continuous floor" for articles. For this reason, the vertical size of the ribs 54 is equal to the total thickness or vertical size of the upper wall 56 and the ribs 68. This is best shown in FIG. 7.

Locking means is provided for the front piece 24 to interconnect the upright wall 36 and the side wall 28. Such locking means comprises an overhang 70 joined to the upright wall 36 and extending rearward along the upper edge of the side wall 28. An engaging lug 72 is formed integrally with the overhang 70 and depends from the overhang 70 to be received in a cutout 74 (shown in FIG. 3) formed in the side wall 28 along its upper edge. The thickness or transverse size "T" (shown in FIG. 5) of the lug 72 is greater than that of the side wall 28.

Figure 8:
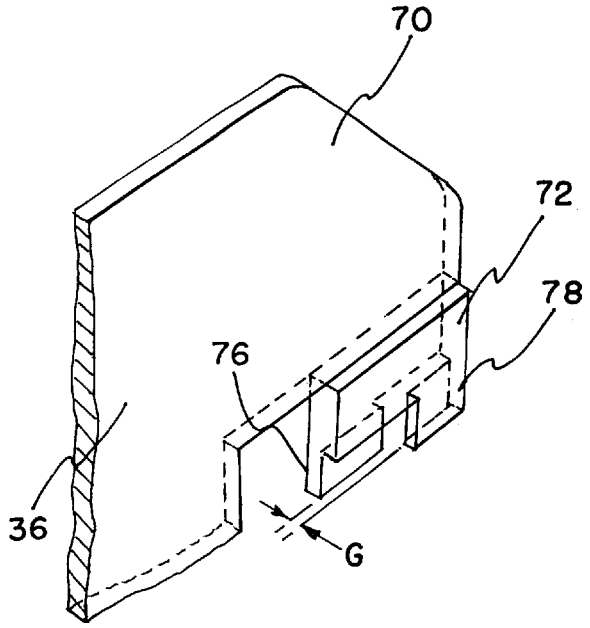
FIG. 8 is an enlarged perspective view of the locking means in FIG. 3.

As best shown in FIGS. 5 and 8, a pair of inner and outer engaging tabs 76 and 78 are joined to the lower end of the lug 72 and extend downwardly therefrom. These engaging tabs 76 and 78 are disposed with a lateral gap "G" between themselves to receive in the gap "G" the horizontally extending periphery of the cutout 74. The illustrated engaging tabs 76 and 78 are disposed at positions offset from each other; however, they may be transversely aligned or opposed across the gap "G".

Figure 9:
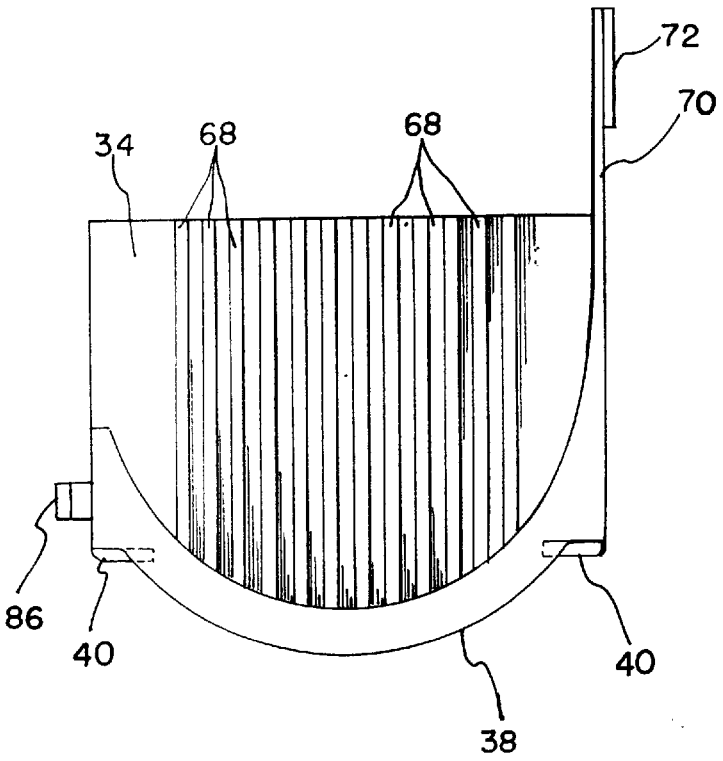
FIG. 9 is a top plan view of the front piece in FIG. 3.

In addition, keyhole apertures 84 (shown in FIGS. 2, 3, 6 and 7) are formed in the upright wall 36 to connect the front piece 24 with the adjacent like front piece. Mating with the keyhole apertures 84 are headed tabs 86 of a T-shaped vertical cross section projecting sideward from the post 42 (shown in FIGS. 4, 5 and 9). These apertures and tabs 84 and 86 cooperate with the aforementioned slots and elements 80 and 82 to interconnect the track device 20 with an adjacent like track device. In place of these illustrated connecting means, however, a variety of conventional mechanisms may be used to secure two adjacent track devices 20 in such a side-to-side, transversely adjacent relationship.

The above body 22 and the front piece 24 may be molded from either plastic or metal; however, they are preferably formed from a plastic material such as polyvinyl chloride, polystyrene, polycarbonate or the like. Among these plastic materials, the most preferred material for manufacturing the body 22 is high impact polystyrene whereas the most preferred material for manufacturing the front piece 24 is polycarbonate. The polystyrene for molding the body 22 may have silicone or some other suitable lubricant material dispersed therein in order to reduce friction between the ribs 54 and the articles to be placed thereon. However, body 22 and the front piece may be formed from the same material. For example, when both the body 22 and the front piece 24 are made of polycarbonate, an entirely transparent track device may be created.

The front piece 24 may be attached to the body 22 in the following manner: The tongue 44 of the body 22 is inserted through the rear end opening (i.e., the entrance of the socket 60) of the deck 34 until the lug 72 abuts the front edge of the side wall 28. The overhang 70 is then slightly flexed toward either side of the side wall 28 to prevent the lug 72 from interfering with the side wall 28. Further forward movement of the tongue 44 causes the hooking rib 52 to abut the rear sloping face 66 of the strip portion 62. As the insertion is continued, the hooking rib 52 is caused to slide upwardly along the sloping face 66 while the medial portion 50 is resiliently bent upwardly. The hooking rib 52 is thus guided along the surface of the strip portion 62 until the tongue 44 is fully inserted to allow the hooking rib 52 to snap-engage the edge 64 of the strip portion 62 (see FIG. 7). This engagement prevents forward displacement or undesired detachment of the deck 34 from the track base 26.

Figure 10:
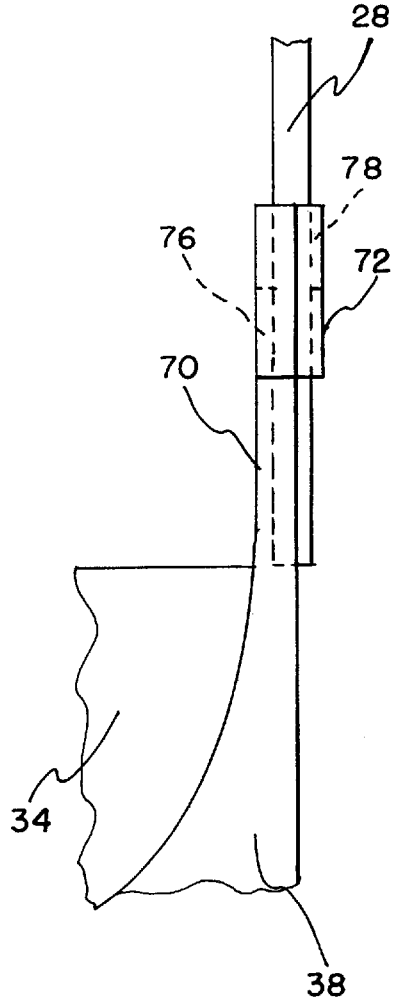
FIG. 10 is an enlarged top plan view of the locking means in FIG. 9.
Figure 11:
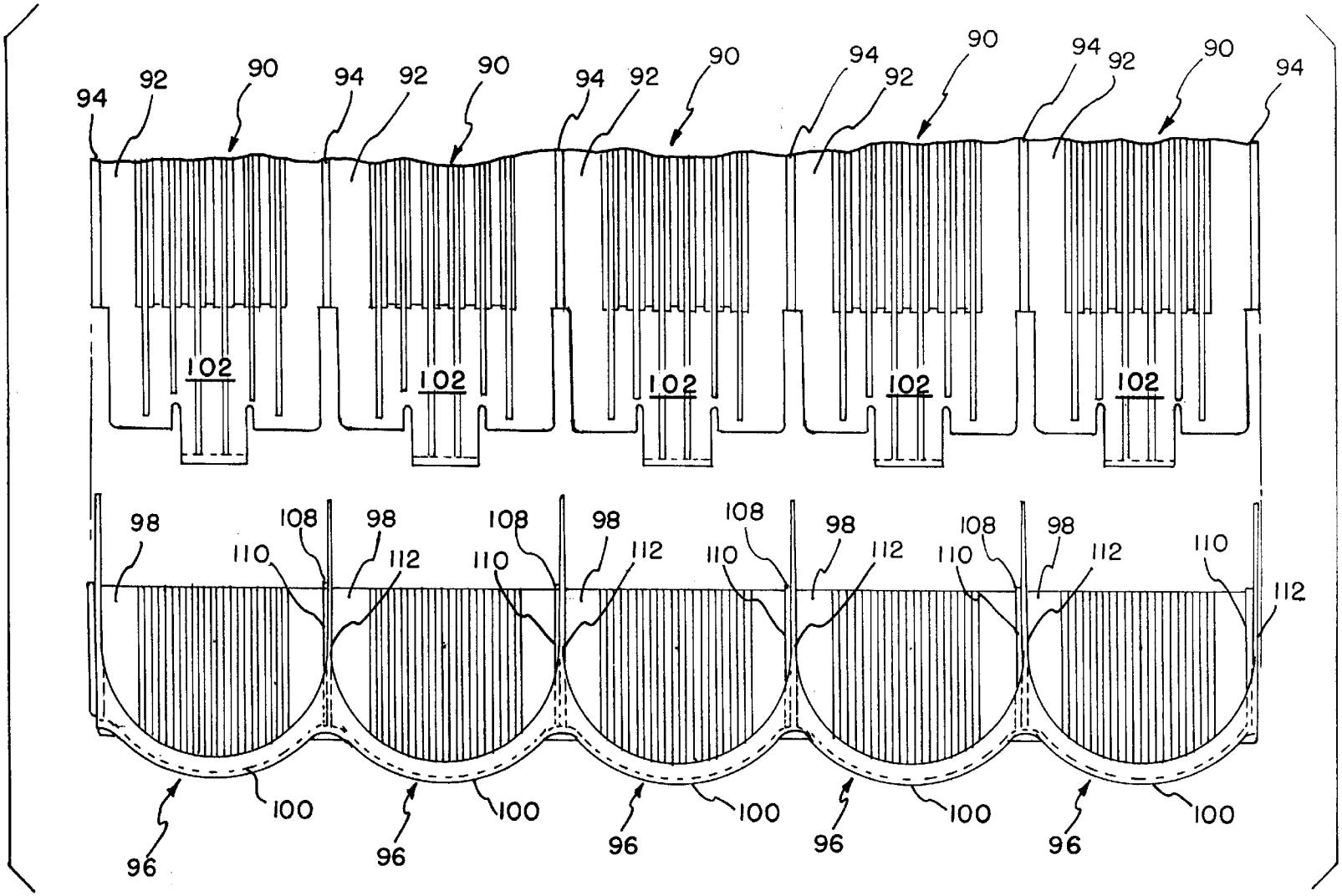
FIG. 11 is an exploded top plan view of the second embodiment of the present invention.
Figure 12:
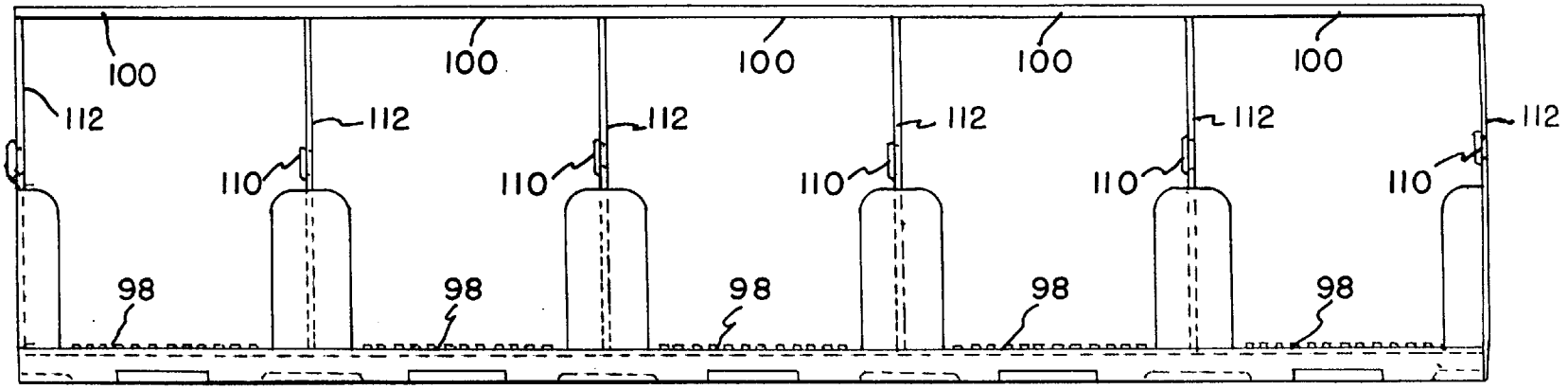
FIG. 12 is a front elevation of the joined front pieces in FIG. 11.
Figure 13:
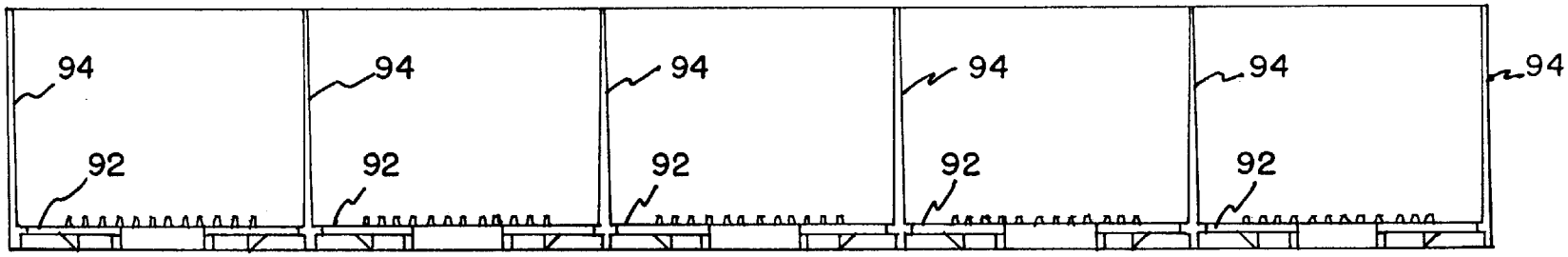
FIG. 13 is a front elevation of the joined bodies in FIG. 11.

Meanwhile the overhang 70 is slightly twisted to manipulate the inner and outer engaging tabs 76 and 78 to receive in the gap "G" the horizontally extending peripheral edge of the cutout 74. By this means, the lug 72 snugly fits into the cutout 74 with the inner and outer engaging tabs 76 and 78 being positioned alongside the inside and outside surfaces of the side wall 28, respectively. Such an arrangement of the inner and outer tabs 76 and 78 is best shown in FIG. 10. This arrangement prevents both forward and lateral displacement of the upright wall 36 with respect to the side wall 28.

It will be recognized that many variations may be made to the foregoing within the scope of the present invention. For example, the track device of the invention may include three or more separately formed, longitudinally adjacent track members, wherein each pair of two adjacent track members are connected together through the locking means and/or the tongue-and-socket joint mentioned above. It should be also recognized that each of the first and second track members 24 and 22 may have a pair of side walls wherein the side walls of the first member 24 are connected respectively to the side walls of the second member 22 through the locking means.

Figure 14:
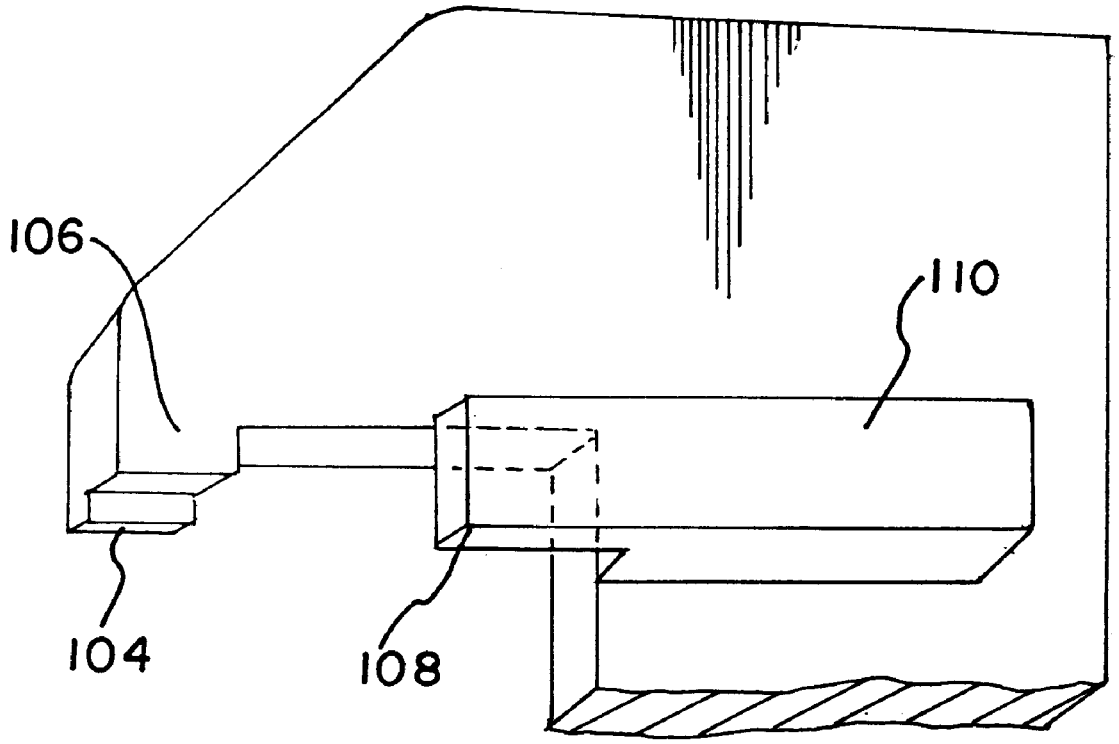
FIG. 14 is an enlarged perspective view of the locking means in FIG. 11.

It should be further recognized that the present invention may be incorporated into a shelf unit wherein multiple first track members are molded together in a side-by-side, longitudinally adjacent relationship and so are multiple second track members. An example of such a variation is illustrated in FIGS. 11–14 wherein a plurality of track bodies 90 are molded together so that the respective track bases 92 are joined together through side walls 94. A plurality of front pieces 96 are also molded together so that the respective decks 98 are joined together and the respective upper stopper elements 100 are joined together in series. Each pair of a body 90 and a front piece 96 employs a tongue 102 and a socket virtually equal to the tongue and the socket described in the foregoing embodiment. However, the locking means used in this embodiment is different from the one in the foregoing embodiment. As shown in FIG. 14, the locking means includes an outer engaging tab 104 depending from the lug 106 and an inner engaging tab 108 extending rearward from a ledge 110 that is formed on the inside surface of the respective upright wall 112. When the front pieces 96 are attached to the bodies 90, the rear end of the ledge 110 is brought into abutment with the forward end of the associated side wall 94, and the inner tab 108 is located alongside the inside surface of the side wall 94.

What is claimed is:

1. A merchandising track device for displaying articles, said track device comprising:

first and second elongate track members formed separately as two discrete structures, said first and second members being connected together in an end-to-end, longitudinally adjacent relationship, each of said members comprising a track base for carrying articles for sliding movement along said each member, and at least one article-guiding side wall upstanding from said track base of said each member and extending along said each member, said one side wall of said first member being disposed in general longitudinal alignment with said one side wall of said second member and including a portion extending upwardly above an upper edge of said one side wall of said second member, said one side wall of said second member having a cutout opening to said upper edge thereof and to opposite side surfaces thereof;

locking means integrally formed with said first member for interconnecting said one side wall of said first member and said one side wall of said second member to lock said members in position relative to each other, said locking means comprising a flexible overhang extending rearward from said portion of said one side wall of said first member and disposed over said upper edge of said one side wall of said second member, said flexible overhang engages side of said one side wall of said second member with a lug formed integrally with said overhang and received in said cutout, whereby longitudinal displacement of said one side wall of said first member relative to said one side wall of said second member is prevented; and a pair of engaging tabs provided disposed respectively alongside said opposite side surfaces of said one side wall of said second member with at least one of said engaging tabs formed on said lug so that lateral displacement of said one side wall of said first member relative to said one side wall of said second member is prevented.

2. A merchandising track device for displaying articles, said track device comprising:

an elongate body having a forward end, said body comprising a track base for carrying a row of articles for sliding movement along said body, a tongue extending forwardly from said track base and defining said forward end of said body, and at least one article-guiding side wall upstanding from said track base and extending along said body;

a front piece formed as a discrete structure separate from said body and attached to said forward end of said body to provide a stopper for preventing a leading article in said row from exiting said track device, said front piece comprising a deck for supporting said leading article, at least one upright wall upstanding from said deck and disposed in general longitudinal alignment with said one side wall, said one upright wall including a portion extending upwardly above an upper edge of said one sidewall; and locking means for interconnecting said one upright wall and said one side wall to lock said front piece in position relative to said body, said locking means including a flexible overhang integrally formed with said front piece and extending rearward from said portion of said one upright wall and disposed over said upper edge of said one side wall with said flexible overhang flexing to either side of said one side wall of said second member; and a pair of engaging tabs disposed respectively alongside opposite side surfaces of said one side wall, at least one of said engaging tabs being integrally formed with said overhang, whereby lateral displacement of said one upright wall relative to said one side wall is prevented, and wherein one sidewall has a cutout opening to said upper edge and said opposite side surface thereof, and at least one engaging tab is formed on a lug to engage in said cutout.

3. The track device according to claim 2, wherein said lug has a thickness greater than a thickness of said one side wall, and both said engaging tabs are formed on said lug.

4. The track device according to claim 2, wherein said tongue is provided with a hooking element projecting therefrom, and said deck has a strip portion having a front and rear opposed faces, said front face providing an edge for engaging said hooking element to prevent forward displacement of said front piece with respect to said body, said rear face sloping to facilitate insertion of said tongue into said socket.

5. The track device according to claim 4, wherein said engaging edge of said deck extends transversely of said body.

6. The track device according to claim 5, wherein said strip portion is provided by said lower wall and extends transversely of said body, said rear face of said strip portion sloping downwardly and rearwardly, said hooking element projecting downwardly from a lower surface of said tongue.

7. The track device according to claim 4, wherein said tongue is formed with at least one notch for dividing said tongue into plural portions so that one of said plural portions exhibits substantial flexibility, and said one of said plural portions is provided with said hooking element.

8. The track device according to claim 2, wherein said engaging tabs are disposed with a lateral gap therebetween to receive in said gap an edge of said one sidewall.

9. The track device according to claim 8, wherein said engaging tabs are opposed to each other across a thickness of said one side wall.

10. The track device according to claim 8, wherein said engaging tabs are disposed at positions offset from each other along a length of said one side wall.

11. The track device according to claim 2, wherein said body and said front piece are formed from different material.

12. The track device according to claim 11, wherein said body is molded of polystyrene, and said front piece is molded of polycarbonate.

13. The track device according to claim 2, wherein said tongue is formed with at least one notch for dividing said tongue into plural portions so that one of said plural portions exhibits substantial flexibility, and said one of said plural portions is provided with said hooking element.

14. A merchandising track device for displaying articles, said track device comprising:

first and second elongate track members formed separately as two discrete structures, said first and second members being connected together in an end-to-end, longitudinally adjacent relationship, each of said members comprising a track base for carrying articles for sliding movement along said each member, and at least one article-guiding side wall upstanding from said track base of said each member and extending along said each member, said one side wall of said first member being disposed in general longitudinal alignment with said one side wall of said second member and including a portion extending upwardly above an upper edge of said one side wall of said second member, said one side wall of said second member having a cutout opening to said upper edge thereof and to opposite side surfaces thereof;

said second member comprising a tongue extending longitudinally from said track base of said second member, said tongue defining an end of said second member, said first member having an end-opening socket for receiving said tongue so that said track bases of said first and second members are interconnected, said tongue being formed on said track base of said second member such that an upper surface of said tongue is disposed below an upper surface of said track base of said second member to allow said upper surface of said track base of said second member and an upper surface of said track base of said first member to form a continuous floor for slidably supporting said articles, wherein said track base of said first member comprises upper and lower opposed walls, and said socket is defined between said upper and lower walls; and locking means integrally formed with said first member for interconnecting said one side wall of said first member and said one side wall of said second member to lock said members in position relative to each other, said locking means comprising a flexible overhang extending rearward from said portion of said one side wall of said first member and disposed over said upper edge of said one side wall of said second member with said flexible overhang flexing to either side of said one side wall of said second member, and a lug with tabs formed integrally with and extending from said overhang and received in said cutout, whereby longitudinal displacement of said one side wall of said first member relative to said one side wall of said second member is prevented.

15. The track device according to claim 14, wherein said tongue is provided with a hooking element projecting therefrom, and said track base of said first member has a strip portion having a front and rear opposed faces, said front face providing an edge for engaging said hooking element to prevent longitudinal displacement of said first member with respect to said second member, said rear face sloping to facilitate insertion of said tongue into said socket.

16. A merchandising track device for displaying articles, said track device comprising:

an elongate body having a forward end, said body comprising a track base for carrying a row of articles for sliding movement along said body, a tongue extending forwardly from said track base and defining said forward end of said body, and at least one article-guiding side wall upstanding from said track base and extending along said body; and a front piece formed as a discrete structure separate from said body and attached to said forward end of said body to provide a stopper for preventing a leading article in said row from exiting said track device, said front piece comprising a deck for supporting said leading article, said deck having a socket for receiving said tongue so that said deck and said track base are interconnected, said tongue being formed on said track base such that an upper surface of said tongue is disposed be low an upper surface of said track base to allow said upper surface of said track base and an upper surface of said deck to form a continuous floor for slidably supporting said articles, at least one upright wall upstanding from said deck and disposed in general longitudinal alignment with said one side wall, said one upright wall including a portion extending upwardly above an upper edge of said one sidewall; and locking means integrally formed with said front piece for interconnecting said one upright wall with said one side wall to lock said front piece in position relative to said body, said locking means including a flexible overhang extending rearward from said portion of said one upright wall and disposed over said upper edge of said one side wall having said cutout, said flexible overhang flexing to either side of said one side wall of said second member; and a pair of engaging tabs disposed respectively alongside opposite side surfaces of said one side wall in a cutout with at least one of said engaging tabs being integrally formed with said overhang so that lateral displacement of said one upright wall relative to said one side wall is prevented.

17. The track device according to claim 16, wherein said tongue is provided with a hooking element projecting therefrom, and said deck has a strip portion having front and rear opposed faces, said front face providing an edge for engaging said hooking element to prevent forward displacement of said front piece with respect to said body, said rear face sloping to facilitate insertion of said tongue into said socket.

* * * * *